US005823000A

United States Patent [19]

Takai

[11] Patent Number: 5,823,000

[45] Date of Patent: Oct. 20, 1998

[54] REFRIGERANT CIRCUIT WITH FLUID FLOW CONTROL MECHANISM

[75] Inventor: Kazubiko Takai, Sawa-gun, Japan

[73] Assignee: Sanden Corporation, Gunma, Japan

[21] Appl. No.: 827,360

[22] Filed: Mar. 27, 1997

[30] Foreign Application Priority Data

Mar. 29, 1996 [JP] Japan ..... 8-075709

[51] Int. Cl.[6] ..... B60H 1/32; F04B 1/26

[52] U.S. Cl. ..... 62/133; 62/228.3; 417/222.2

[58] Field of Search ..... 62/228.3, 228.5, 62/133; 417/222.2, 213

[56] References Cited

U.S. PATENT DOCUMENTS

| | | | |
|---|---|---|---|
| 1,984,054 | 9/1934 | Carraway | 62/222 |
| 2,326,093 | 8/1943 | Carter | 62/511 X |
| 2,415,338 | 4/1947 | Carter | 62/511 X |
| 3,121,315 | 2/1964 | Matthies | 62/180 |
| 3,367,130 | 2/1968 | Owens | 62/222 |
| 3,462,965 | 8/1969 | Miner | 62/180 |
| 3,564,865 | 2/1971 | Spencer et al. | 62/197 |
| 3,638,446 | 2/1972 | Palmer | 62/202 |
| 3,786,651 | 1/1974 | Eschbaugh et al. | 62/222 |
| 4,145,163 | 3/1979 | Fogelberg et al. | 417/222 |
| 4,208,886 | 6/1980 | Maudlin | 62/498 |
| 4,324,112 | 4/1982 | Fujiware et al. | 62/511 |
| 4,788,828 | 12/1988 | Sato | 62/214 |
| 4,796,438 | 1/1989 | Sato | 62/133 |
| 4,840,038 | 6/1989 | Sato | 62/210 |
| 4,840,039 | 6/1989 | Takai | 62/244 |
| 4,905,477 | 3/1990 | Taki | 62/228.5 |
| 5,332,365 | 7/1994 | Taguchi | 417/222.2 |
| 5,425,303 | 6/1995 | Shimizu et al. | 417/269 X |
| 5,688,111 | 11/1997 | Takai | 417/298 |

FOREIGN PATENT DOCUMENTS 0330965 9/1989 European Pat. Off. .

*Primary Examiner*—William E. Wayner
*Attorney, Agent, or Firm*—Baker & Botts, L.L.P.

[57] ABSTRACT

A fluid flow control mechanism for use in a refrigerant circuit of vehicle has a compressor, a condenser, and an evaporator connected to each other in series. The fluid control mechanism includes a passageway control device having an actuating chamber therein and controlling to change the size of an opening of the inlet of the compressor in response to a pressure difference between the inlet of the compressor and the actuating chamber. A valve control device connects the actuating chamber of the passageway control device with the outlet of the compressor and the inlet of the compressor to minimize a pressure difference between the inlet of the compressor and the actuating chamber when the vehicle accelerates. The fluid flow control mechanism reduces the excessive load on the compressor caused by the vehicle accelerating while simultaneously preventing torque shock when the compressor is started.

22 Claims, 5 Drawing Sheets

REFRIGERANT CIRCUIT WITH FLUID FLOW CONTROL MECHANISM

BACKGROUND OF THE INVENTION

1. Field of the Invention

The present invention relates to refrigerant circuits generally, and more particularly, to a refrigerant circuit having a fluid flow control mechanism for an automotive air-conditioning system.

2. Description of the Related Art

Refrigerant circuits for use in air conditioning systems are well known, and may be of the orifice type, which includes a compressor, a condenser, an orifice, an evaporator, and an accumulator or an expansion valve-type, which includes a compressor, a condenser, a receiver dryer, an expansion valve, and an evaporator. In either of these conventional refrigerant circuits, if the compressor is started when the refrigerant pressure at the inlet of the compressor is equal to the gas pressure at the outlet of the compressor, an increase in the drive torque of the compressor results as a refrigerant gas flows from the inlet to outlet, thereby causing a reduction in the rotation frequency of the drive source. This reduction results because a relatively large amount of refrigerant gas is introduced into a compression chamber, and a great deal of power is required to compress this refrigerant gas. For example, in the refrigerant circuit for an automotive air conditioning system, this reduction of the rotational frequency of the automotive engine may cause torque shock.

One attempt to solve the problem described above is disclosed in the U.S. Pat. No. 4,905,477 to Takai, the inventor of the present application. With reference to FIG. 1, the '477 Patent describes a passageway control device 26 disposed within one end of a cylinder head 12. Passage control device 26 comprises a valve 261 which includes a piston 261*a* and a valve portion 261*b*, a coil spring 262, and a screw 263 which includes spring seat 263*a*. A cylinder 125 is formed within cylinder head 12 and extends from an inlet port 123. A passageway 150 is formed in cylinder head 12 to permit communication between cylinder 125 and a discharge chamber 122. Piston 261*a* is reciprocally fitted within cylinder 125. Valve portion 261*a* varies the size of the opening of the passageway between a suction chamber 121 and inlet port 123 in accordance with operation of piston 261*a*. Coil spring 262 is disposed between valve portion 261*b* and spring seat 263*a*, and is attached to valve portion 261*b* at one end and supported on the inner end of spring seat 263*a* at the other end. Coil spring 262 normally urges valve portion 261*b* to close the opening against the refrigerant pressure in discharge chamber 122. Screw 263 may be used to adjust the recoil strength of coil spring 262.

When the compressor is started under the condition that the refrigerant pressure in suction chamber 121 is equal to the pressure in discharge chamber 122, piston 261*a* is urged downward to close the passageway between suction chamber 121 and inlet port 123. Thereafter, when compressor 1 is driven by the rotation of drive shaft 14, the flow volume of refrigerant, which is sucked into suction chamber 121, is limited by the size of the passageway opening, and the refrigerant pressure in cylinder 104 rapidly reduces. The refrigerant level in crank chamber 103, therefore, becomes greater than that in suction chamber 121, thereby increasing the pressure difference between the two chambers. The high fluid pressure in crank chamber 103 acts on the rear surface of piston 22 thereby reducing the angle of inclination of inclined plate 18 with respect to drive shaft 14. The stroke volume of piston 22 correspondingly decreases and, as a result, the volume of refrigerant gas drawn into cylinder 104 decreases.

Therefore, passageway control device 26 reduces the amount of engine power needed to compress the refrigerant gas at the start of compressor operation, as compared with a conventional refrigerant circuit. As a result, the refrigerant circuit having passageway control device 26 prevents the occurrence of "torque shock" when the compressor is started.

However, when the vehicle rapidly accelerates while driving, the flow volume of refrigerant which is drawn into suction chamber 121 increases because the rotational speed of the compressor increases. The volume of refrigerant gas taken into cylinder 104 also rapidly increases.

The compressor may be provided with a variable capacity mechanism. In particular, when the pressure in suction chamber 121 is lower than a predetermined value, communication between suction chamber 121 and crank chamber 103 is obstructed by valve control mechanism 25. Under this condition, the pressure in crank chamber 103 gradually increases between blow-by gas leaks into crank chamber 103 through a gap between the inner wall surface of cylinder 104 and the outer surface of piston 22. Gas pressure in crank chamber 103 acts on the rear surface of piston 22, and changes the balancing moment acting on inclined plate 18. The angle of inclined plate 18 relative to drive shaft 14 is thereby decreased, and the stroke of piston 22 thus is also decreased. As a result, the volume of refrigerant gas drawn into cylinder 104 is decreased. The capacity of the compressor is thus varied.

On the other hand, when the pressure in suction chamber 121 exceeds a predetermined value, the refrigerant gas in crank chamber 103 flows into suction chamber 121 via control valve 25, and the pressure in crank chamber 103 is decreased. Gas pressure, which acts on the rear surface of piston 22, also decreases in correspondence with decreasing gas pressure in crank chamber 103. The balancing moment acting on inclined plate 20 consequently increases, so that the angle of inclined plate 20 relative to drive shaft 14 also changes. The stroke of piston 22 is thereby increased, and the volume of refrigerant gas being compressed also is increased. Nevertheless, the variable capacity mechanism described above cannot quickly cope with the excessive increases of the suction refrigerant gas described above.

Therefore, this configuration also has disadvantages. Although the refrigerant circuit with a passageway control valve device 26 avoids the reduction of the rotational frequency of the automotive engine, i.e., the occurrence of "torque shock," a large amount of engine power is required to compress the refrigerant gas when the vehicle accelerates.

SUMMARY OF THE INVENTION

It is an object of the present invention to provide a refrigerant circuit for a vehicle having a fluid flow control mechanism, which forcibly reduces the load of a compressor when the vehicle accelerates while simultaneously preventing the occurrence of torque shock when the compressor is started.

According to the present invention, a fluid flow control mechanism for use in a refrigerant circuit of a vehicle includes a compressor, a condenser, and an evaporator connected to each other in series. The fluid control mechanism comprises a passageway control device disposed between an outlet side of the evaporator and an inlet side of the compressor. The passageway control device has an actuating chamber therein and adjusts a size of an opening of the inlet of the compressor in response to a pressure difference between the inlet of the compressor and the actuating chamber. Further, the passageway control devices operates to adjust the size of the opening of the inlet of the compressor to a large size responsive to a greater pressure difference and into a smaller size responsive to a lesser pressure difference. The valve control device connects the actuating chamber of the passageway control device with the outlet of the compressor and the inlet of the compressor in order to minimize, e.g., reduce to zero, a pressure difference between the inlet of the compressor and the actuating chamber when the vehicle accelerates.

Further objects, features, and advantages of this invention will be understood from the following detailed description of the invention taken in conjunction with the accompanying drawings.

DETAILED DESCRIPTION OF THE PREFERRED EMBODIMENTS

Figure 1:
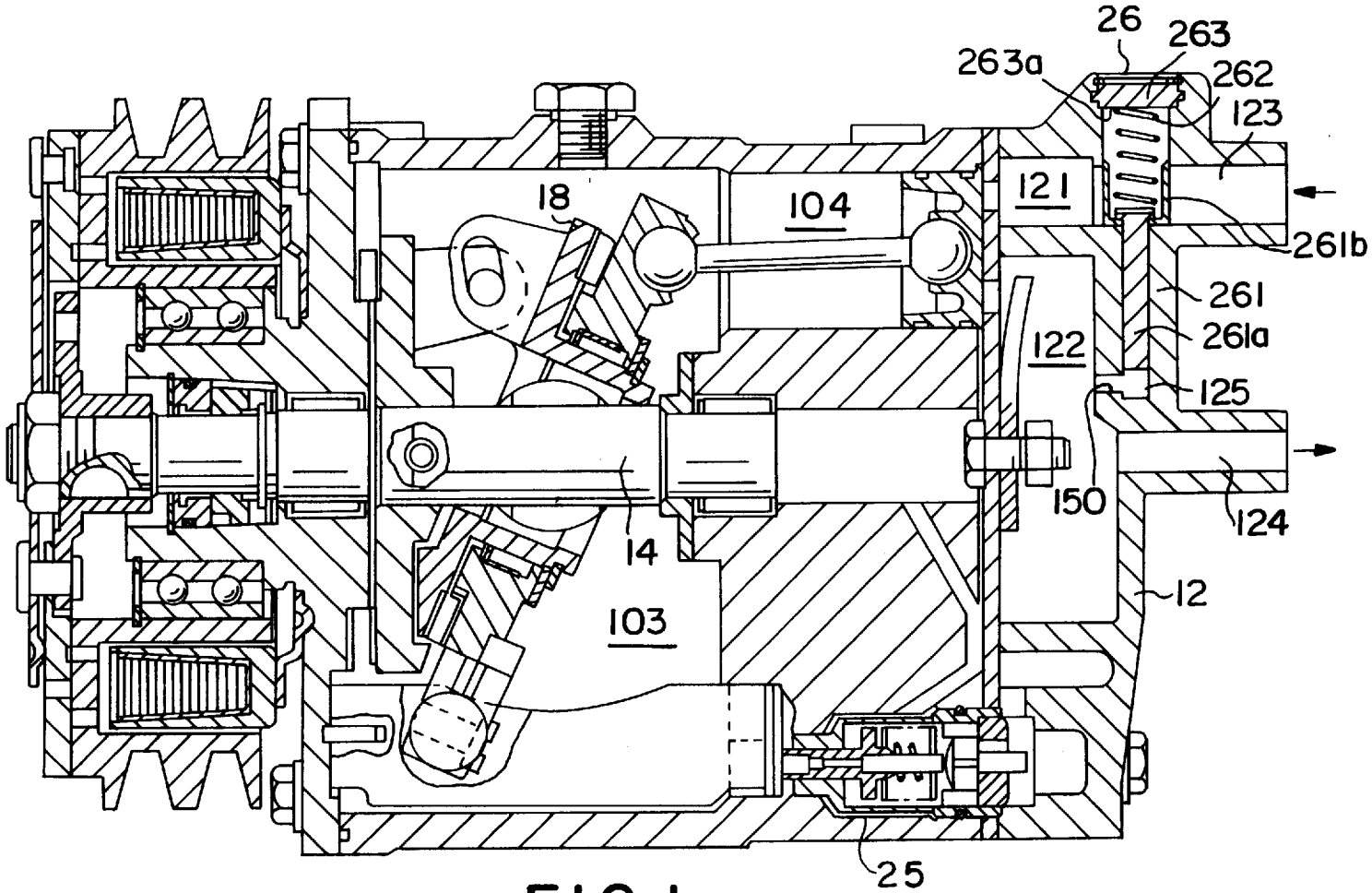
FIG. 1 PRIOR ART
FIG. 1 is a longitudinal cross-sectional view of a swash plate-type refrigerant compressor with a variable displacement mechanism in accordance with the prior art.
Figure 2:
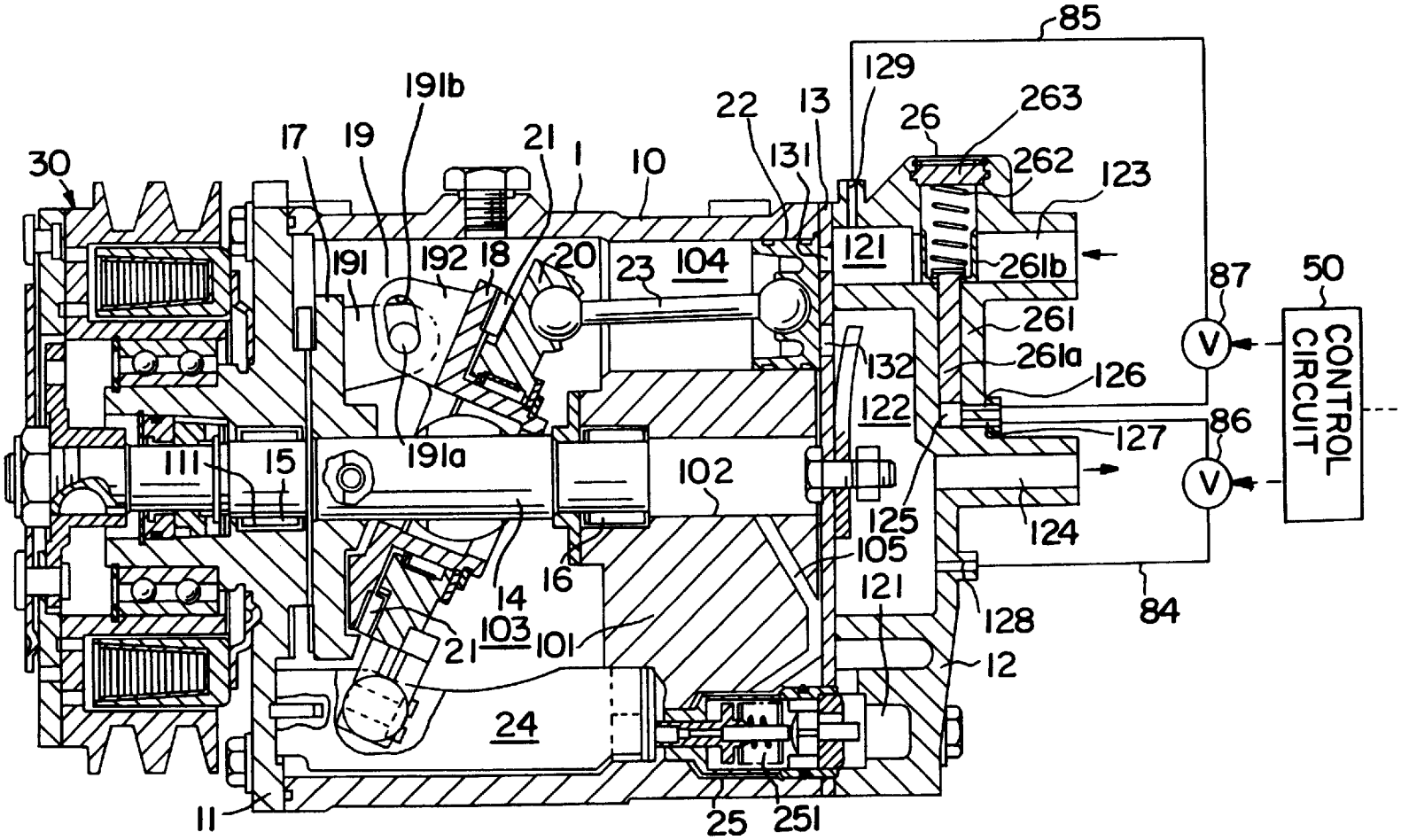
FIG. 2 is a longitudinal cross-sectional view of a swash plate-type refrigerant compressor with a variable displacement mechanism a piston in accordance with a first embodiment of the present invention.
Figure 3:
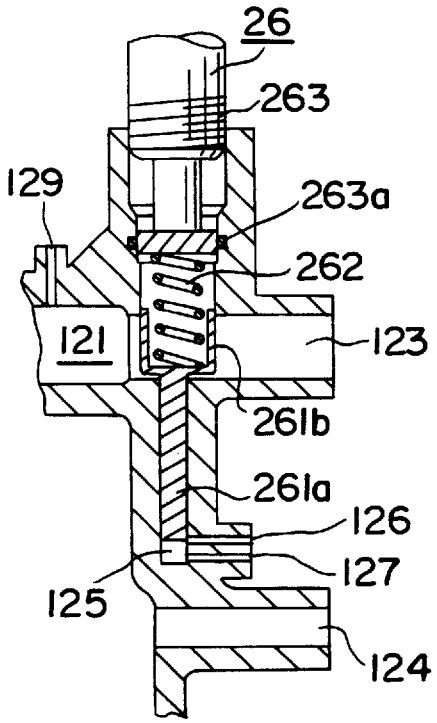
FIG. 3 is an enlarged cross-sectional view of a passageway control valve mechanism in accordance with a first embodiment of the present invention.

Referring to FIGS. 2 and 3, the construction of a wobble plate-type compressor having a variable displacement mechanism is shown. In FIG. 3, the left side will be referred to as the forward end or the front of the compressor, and the right side will be referred to as the rearward end or rear of the compressor.

Compressor 1 includes a closed housing assembly formed by a cylindrical compressor housing 10, front end plate 11, and rear end plate in the form of cylinder head 12. Cylinder block 101 and crank chamber 103 are located in compressor housing 10. Front end plate 11 is attached to one end surface of compressor housing 10, and cylinder head 12 is disposed on the opposite end surface of compressor housing 10 and is fixedly mounted on one end surface of cylinder block 101 through a valve plate 13. Opening 111 is formed in the central portion of front end plate 11 to receive a drive shaft 14.

Drive shaft 14 is rotatably supported in front end plate 11 through a bearing 15. An inner end portion of drive shaft 14 also extends into central bore 102 formed in the central portion of cylinder block 101, and is rotatably supported therein by a bearing 16. A rotor 17 is disposed in the interior of crank chamber 103 and is connected to drive shaft 14 to be rotatable therewith. Rotor 17 engages an inclined plate 18 through a hinge mechanism 19. Wobble plate 20 is disposed on the opposite side surface of inclined plate 18 and bears against plate 18 through a bearing 21.

Hinge mechanism 19 includes a first tab portion 191, including pin portion 191*a* formed on the inner end surface of rotor 17, and a second tab portion 192, having longitudinal hole 191*b*, formed on one end surface of inclined plate 18. The angle of inclination of inclined plate 18 with respect to drive shaft 14 may be adjusted by hinge mechanism 19.

A plurality of equiangularly spaced cylinders 104 are formed in cylinder block 101, and a piston 22 is reciprocatingly disposed within each cylinder 104. Each piston 22 is connected to wobble plate 20 through a connecting rod 23, i.e., one end of each connecting rod 23 is connected to wobble plate 20 with a ball joint, and the other end of each connecting rod 23 is connected to one of pistons 22 by means of a ball joint. A guide bar 24 extends within crank chamber 103 of compressor housing 10. The lower end portion of wobble plate 20 engages guide bar 24 to enable wobble plate 20 to reciprocate along the guide bar while preventing rotational motion.

Thus, pistons 22 are reciprocated in cylinders 104 by a drive mechanism formed of drive shaft 14, rotor 17, inclined plate 18, wobble plate 20, and connecting rods 23. Connecting rods 23 function as a coupling mechanism to convert the rotational motion of rotor 17 into reciprocating motion of the pistons 22.

Cylinder head 12 is provided with a suction chamber 121 and a discharge chamber 122, which communicate with each of cylinders 104 through a suction hole 131 and a discharge hole 132, respectively, formed through valve plate 13. Cylinder head 12 also is provided with an inlet port 123 and an outlet port 124 which place suction chamber 121 and discharge chamber 122 in fluid communication with an external refrigerant circuit.

A bypass hole or passageway 105 is formed in cylinder block 101 to permit communication between suction chamber 121 and crank chamber 103 through central bore 102. Communication between chambers 121 and 103 is controlled by control valve mechanism 25. Control valve mechanism 25 is positioned between cylinder block 101 and cylinder head 12, and includes bellows element 251. Bellows elements 251 is operated to control communication between the chambers and is responsive to pressure differences between suction chamber 121 and crank chamber 103.

In addition, passageway control device 26 is disposed within one end of cylinder head 12 and includes a valve 261, which further includes a piston portion 261*a* and a valve portion 261*b*, a coil spring 262, and a screw mechanism 263 having a spring seat 263*a*. A cylinder portion 125 is formed within cylinder block 12 to permit communication with suction chamber 121. Piston portion 261*a* of valve 261 is reciprocally disposed within cylinder portion 125. Valve portion 261*b* varies the size of the opening of the passageway between suction chamber 121 and inlet port 123 in correspondence with operation of piston portion 261*a*. Coil spring 262 is disposed between valve portion 261*b* and spring seat 263*a* and is attached to valve portion 261*b* at one end and is supported on the inner end of spring seat 263*a* at the other end. Coil spring 262 normally urges valve portion 261*b* to reduce the size of the opening of the passageway until the size of the opening is minimized against the refrigerant pressure in cylinder 125. Spring seat 263*a* adjusts the recoil strength of coil spring 262 by screwing a screw mechanism 263. Thus, the efficiency and objects of this embodiment also may be achieved by disposing passageway control device 26 at other positions between the exterior of an evaporator and an inlet of a compressor or in an evaporator. Further, in this configuration, a cylinder and a valve with a piston portion is used in the drive means of passageway control device 26. However, other drive means responsive to pressure differences, such as a bellows or diaphragm, also may be used. Moreover, electromagnetic forces, external pressure forces, and bimetal forces created by a combination of metals having different coefficients of thermal expansion may be used to replace the spring mechanism.

Further, first and second conduits 126 and 127 are formed within cylinder head 12, such that they communicate between cylinder portion 125 and the exterior of compressor 1. A third conduit 128 is formed within cylinder head 12 to permit communication between discharge chamber 122 and the exterior of compressor 1. Further, a fourth conduit 129 is formed within cylinder head 12 to permit communication between suction chamber 121 and the exterior of compressor 1. A first fluid pipe 84 links second conduit 127 to third conduit 128. A second fluid pipe 85 links first conduit 126 to fourth conduit 129. A first valve 86, such as an electrically or mechanically controlled valve, for closing and opening first fluid pipe 84 is disposed in first fluid pipe 84. A second valve 87, such as an electrically or mechanically controlled valve, for closing and opening second fluid pipe 85 is disposed in a second fluid pipe 85. First and second valves 86 and 87 are connected, e.g., electrically connected, to a control unit 50 which is connected, e.g., electrically connected, to a sensor (not shown), such as an acceleration cut-off switch that operates in response to the movement of the accelerator of a vehicle. Consequently, passageway control device 26, first and second fluid pipes 84 and 85, first and second valves 86 and 87, and control unit 50 collectively form a fluid flow control mechanism.

The operation of the fluid flow control mechanism is described below. When compressor 1 is started by a driving source, such as the engine of a vehicle, by means of an electromagnetic clutch 30, the refrigerant pressure in suction chamber 121 is equal to the pressure in discharge chamber 122. Control unit 50 generates a command signal to first and second valves 85 and 87, such that first valve 85 is opened, and second valve 87 is closed. Piston portion 261*a* of valve 261 of passageway control device 26 is urged downward to close the passageway opening between suction chamber 121 and inlet port 123, but permitting a predetermined minimum opening size. Thereafter, when drive shaft 14 begins to rotate, the refrigerant pressure in cylinder 104 is rapidly reduced. The refrigerant level in crank chamber 103, therefore, becomes greater than that in suction chamber 121, thereby increasing the pressure difference between those two chambers. The increased fluid pressure in crank chamber 103 acts on the rear surface of piston 22 thereby reducing the angle of inclination of inclined plate 18 with respect to drive shaft 14, and nutational motion of wobble plate also is reduced. This decreases the stroke volume of piston 22, and consequently, the volume of refrigerant gas drawn into cylinder 104 decreases. Therefore, compressor 1 may start without reducing the rotational frequency of the automotive engine, i.e., the occurrence of "torque shock."

Further, when compressor 1 is continuously driven, the amount of refrigerant drawn into suction chamber 121 from inlet port 123 through the opening increases because the valve portion 261*a* of valve 261 of passageway control device 26 is urged upward as the refrigerant pressure in cylinder portion 125, which is introduced from discharge chamber 122 via first fluid pipe 84 and first valve 86, increases. Therefore, the flow volume of refrigerant which is drawn into suction chamber 121 reaches a predetermined maximum level. Moreover, the differential pressure between crank chamber 103 and suction chamber 121 decreases, thereby increasing the angle of inclination of inclined plate 18 with respect to drive shaft 14, and the nutational motion of wobble plate 20 increases. This increases the stroke volume of piston 22 and, consequently, the volume of refrigerant gas drawn into cylinder 104 increases, and the capacity of the compressor also increases.

When the vehicle needs to accelerate, control unit 50 receives a signal from an acceleration cut-off switch (not shown), which is in response to the movement of the vehicle's accelerator, and generates a command signal to first and second valves 86 and 87, such that first valve 86 is closed, and second valve 87 is opened.

Cylinder portion 125 is then no longer subjected to the discharge pressure from discharge chamber 122, and the pressure in cylinder portion 125 is rapidly reduced to a level equal to that of the pressure in suction chamber 121 because second fluid pipe 85 is opened by second valve 87. As a result, piston portion 261*a* of valve 261 of passageway control device 26 is urged downward to close the passageway opening between suction chamber 121 and inlet port 123 by the recoil strength of coil spring 262 until the size of the opening is minimized. The flow volume of refrigerant, which is drawn into suction chamber 121, is limited by the size of the passageway opening, and the refrigerant pressure in cylinder 104 is rapidly reduced. The refrigerant level in crank chamber 103, therefore, becomes greater than that in suction chamber 121, thereby increasing the pressure difference between these two chambers. The greater fluid pressure in crank chamber 103 acts on the rear surface of piston 22, thereby reducing the angle of inclination of inclined plate 18 with respect to drive shaft 14 (e.g., approaching 90 degrees), and the nutational motion of wobble plate 20 also is reduced. This decreases the stroke volume of piston 22 and, consequently, the volume of refrigerant gas drawn into cylinder 104 decreases, and the capacity of the compressor also is decreased.

As a result, this configuration instantly reduces consumption of horse power by the compressor when the compressor is supplied with a high rotational frequency by the engine of the vehicle. In particular, this configuration achieves a large reduction in the amount of engine power required to compress the refrigerant gas when the vehicle accelerates, while simultaneously avoiding the reduction of the rotational frequency of the automotive engine, i.e., the occurrence of "torque shock" when the compressor starts. Further, the vehicle with this refrigerant circuit having the compressor may smoothly accelerate.

Figure 4:
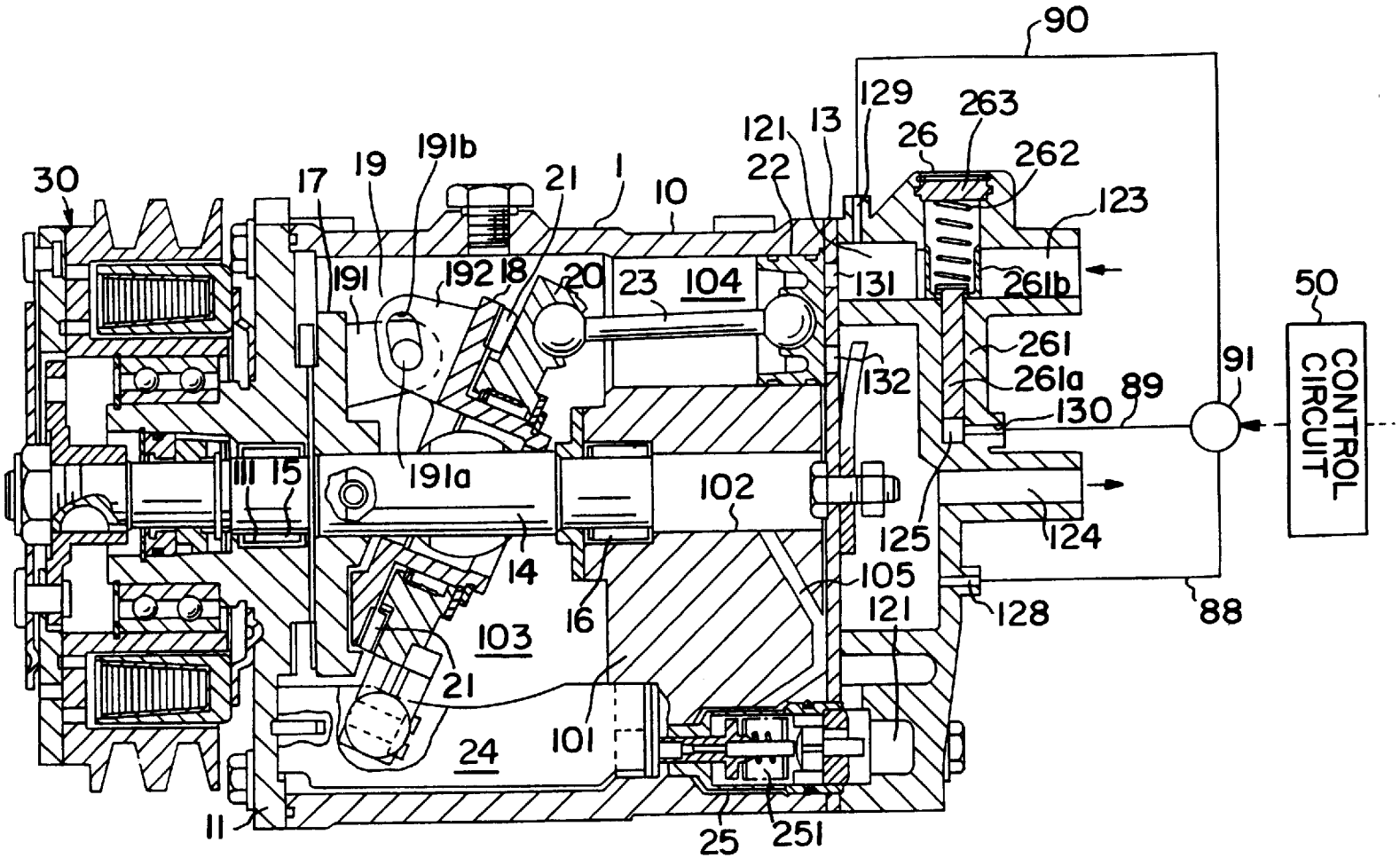
FIG. 4 is a longitudinal cross-sectional view of a swash plate-type refrigerant compressor with a variable displacement mechanism a piston in accordance with a second embodiment of the present invention.

FIG. 4 illustrates a second embodiment of the present invention, which is substantially similar to the first embodiment, except for the following structures. A first fluid pipe 88 links third conduit 128 to a fifth conduit 130, which is formed in cylinder head 12 and places cylinder 125 in communication with the exterior of compressor 1, to a second open end of three-way valve 91. A third fluid pipe 90 links fourth conduit 129 to a third open end of a three-way valve 91. Three-way valve 91 is connected, e.g., electrically connected, to control unit 50. Therefore, passageway control device 26; fluid pipes 88, 89, and 90; three-way valve 91; and control unit 50 collectively form a fluid flow control mechanism.

When compressor 1 is started by a driving source, such as the engine of a vehicle, by means of electromagnetic clutch 30, control unit 50 generates a command signal to three-way valve 91 to obstruct communication between first fluid pipe 88 and second fluid pipe 89 and to permit communication between second fluid pipe 89 and third fluid pipe 90. Further, when the vehicle accelerates, control unit 50 receives a signal from an acceleration cut-off switch and generates a command signal to three-way valve 91 to permit communication between first fluid pipe 88 and second fluid pipe 89 and third fluid pipe 90.

In such structures, substantially similar operation and advantages to those described with respect to the first embodiment may be obtained.

Figure 5:
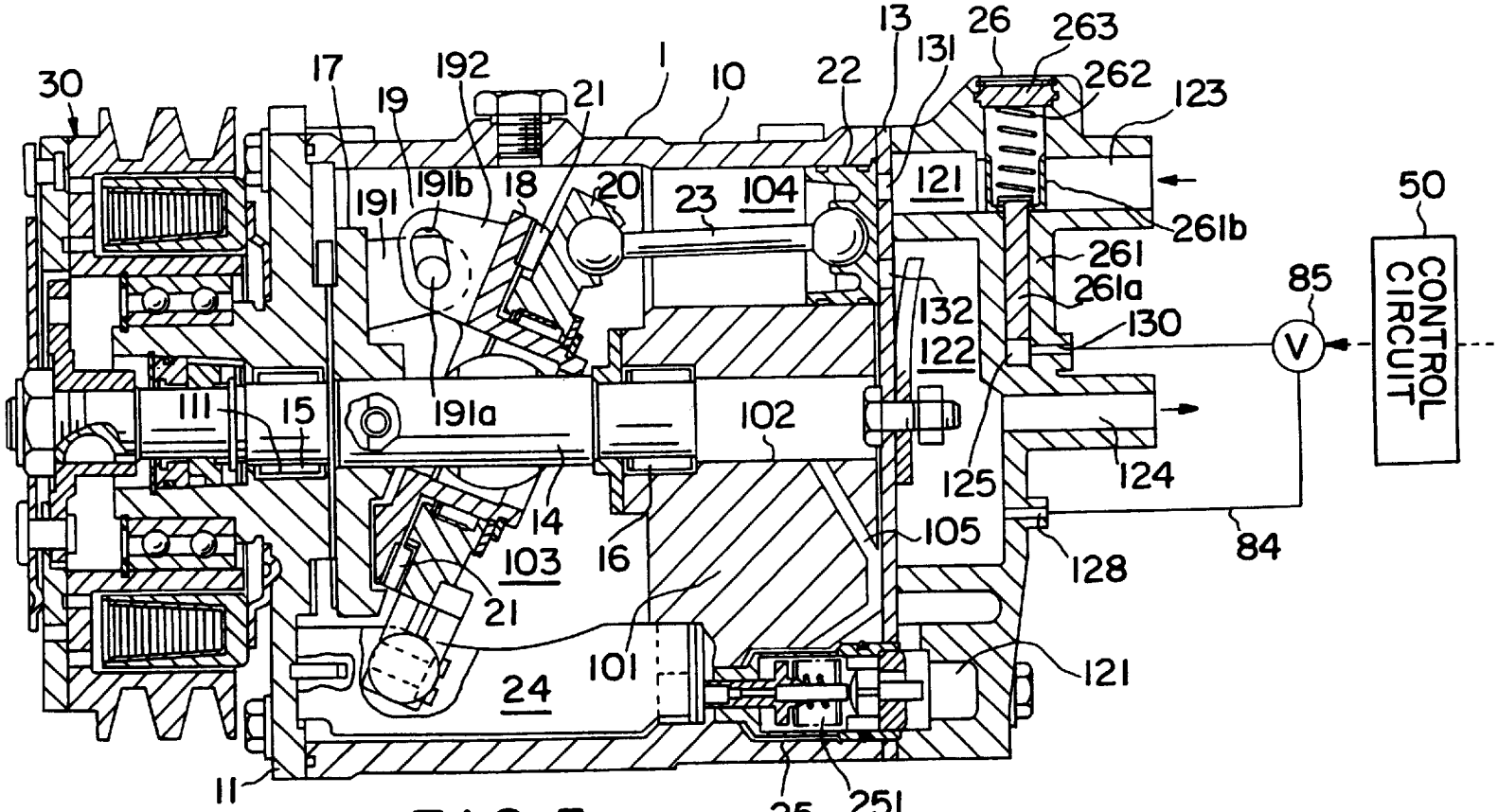
FIG. 5 is a longitudinal cross-sectional view of a swash plate-type refrigerant compressor with a variable displacement mechanism a piston in accordance with a third embodiment of the present invention.

FIG. 5 illustrates a third embodiment of the present invention, which is substantially similar to the first embodiment, except for the following structures. A first fluid pipe 84 links third conduit 128 to fifth conduit 130. A first valve 85, such as an electrically or mechanically controlled valve, for closing and opening first fluid pipe 84 is disposed in first fluid pipe 84. Therefore, passageway control device 26, first fluid pipe 84, first valve 85, and control unit 50 collectively form a fluid flow control mechanism. Thus, when the vehicle accelerates, control unit 50 generates a command signal to first valve 85, such that first valve 85 is closed. Consequently, cylinder portion 125 is no longer subjected to the discharge pressure of discharge chamber 122. In this embodiment, the pressure in cylinder portion 125 is reduced to the level equal to the pressure in suction chamber 121 because the refrigerant gas in cylinder portion 125 leaks into suction chamber 121 through a gap created between cylinder portion 261*a* and cylinder 125.

In such structures, substantially similar operation and advantages to those described with respect to the first embodiment may be obtained.

Although the present invention has been described above in connection with preferred embodiments, the invention is not limited thereto. Specifically, while the preferred embodiments illustrate the invention in a swash plate-type refrigerant compressor, this invention is not restricted to a swash plate-type refrigerant compressor with a variable displacement mechanism, but may be employed in other piston-type refrigerant compressors, not provided with a variable displacement mechanism. It will be readily understood by those of ordinary skill in the art that variations and modifications may be made within the scope of this invention as defined by the following claims. Accordingly, the embodiments and features disclosed herein are provided by way of example. It is to be understood that the scope of the present invention is not to be limited thereby, but is to be determined by the claims which follow.

What is claimed is:

1. A fluid flow control means for use in a refrigerant circuit of a vehicle, having a compressor, a condenser, and an evaporator connected to each other in series, said fluid control means comprising:

a passageway control device disposed between an outlet of said evaporator and an inlet of said compressor, said passageway control device having an actuating chamber therein and adjusting a size of an opening of said inlet of said compressor in response to a pressure difference between said inlet of said compressor and said actuating chamber, wherein said passageway control device operates to increase the size of said opening of said inlet of said compressor in response to increases in said pressure difference and to decrease the size of said opening in response to decreases in said pressure difference; and pressure control means for connecting said actuating chamber of said passageway control device with said outlet of said compressor and said inlet of said compressor for minimizing said pressure difference between said inlet of said compressor and said actuating chamber, when said vehicle accelerates.

2. The fluid flow control means of claim 1, wherein said fluid control means further comprises a control unit for providing a control signal to said valve device which operates in response to a movement of an accelerator of said vehicle.

3. The fluid flow control means of claim 1, wherein said compressor is a compressor with a variable displacement mechanism.

4. The fluid flow control means of claim 1, wherein said pressure control means comprises a first valve closing a first communication passageway between said outlet of said compressor and said actuating chamber of said passageway control device and a second valve opening a second communication passageway between said inlet of said compressor with said actuating chamber, when said vehicle accelerates.

5. The fluid flow control means of claim 1, wherein said pressure control means is a three-way valve closing a first communication passageway between said outlet of said compressor and said actuating chamber of said passageway control device and opening a second communication passageway between said inlet of said compressor with said actuating chamber, when said vehicle accelerates.

6. The fluid flow control means of claim 1, wherein said pressure control means is a valve connecting said outlet of said compressor with said actuating chamber of said passageway control device.

7. The fluid flow control means of claim 1, wherein said passageway control device comprises a valve mechanism including a cylinder bore, a valve portion, a spring seat, and a spring member, wherein said spring member is disposed between said valve portion and said spring seat.

8. The fluid flow control means of claim 1, wherein said passageway control device comprises a valve mechanism including a bellows, a valve portion, a spring seat, and a spring member, wherein said spring member is disposed between said valve portion and said spring seat.

9. The fluid flow control means of claim 1, wherein said passageway control device comprises a valve mechanism including a diaphragm, a valve portion, a spring seat, and a spring member, wherein said spring member is disposed between said valve portion and said spring seat.

10. The fluid flow control means of claim 1, wherein said first and second valves are electrically controlled valves.

11. The fluid flow control means of claim 1, wherein said first and second valves are mechanically controlled valves.

12. A slant plate-type compressor for a vehicle with a capacity or displacement adjusting mechanism comprising:

a housing including a plurality of cylinders, a crank chamber, a suction chamber, and a discharge chamber;

a plurality of pistons, each piston slidably disposed within one of said cylinders;

a drive shaft rotatably supported in said housing;

coupling means coupled to said drive shaft and having a surface with an adjustable angle of inclination, said angle controlled by pressure in said crank chamber and by said coupling means driving said pistons in reciprocating motion;

means for controlling pressure in said crank chamber including a passageway between said crank chamber and said suction chamber; and a fluid control means including:

a passageway control device disposed between an outlet of an evaporator and an inlet of a compressor, said passageway control device having an actuating chamber therein and controlling a size of an opening on said inlet side of said compressor in response to a pressure difference between said inlet of said compressor and said actuating chamber, wherein said passageway control device operates to increase the size of said opening on said inlet side of said compressor in response to increases in said pressure difference and to decrease the size of said opening in response to decreases in said pressure difference; and pressure control means connecting said actuating chamber of said passageway control device with said outlet of said compressor and said inlet of said compressor for minimizing said pressure difference between said inlet of said compressor and said actuating chamber, when said vehicle accelerates.

13. The slant plate-type compressor of claim 12, wherein said fluid control means further comprises a control unit for providing a control signal to said pressure control means which operates in response to a movement of an accelerator of said vehicle.

14. The slant plate-type compressor of claim 12, wherein said compressor is a compressor with a variable displacement mechanism.

15. The slant plate-type compressor of claim 12, wherein said pressure control means comprises a first valve closing a first communication passageway between said outlet of said compressor and said actuating chamber of said passageway control device and a second valve opening a second communication passageway between said inlet of said compressor with said actuating chamber, when said vehicle accelerates.

16. The slant plate-type compressor of claim 15, wherein said first and second valves are electrically controlled valves.

17. The slant plate-type compressor of claim 15, wherein said first and second valves are mechanically controlled valves.

18. The slant plate-type compressor of claim 12, wherein said pressure control means comprises a three-way valve closing a first communication passageway between said outlet of said compressor and said actuating chamber of said passageway control device and opening a second communication passageway between said inlet of said compressor with said actuating chamber, when said vehicle accelerates.

19. The slant plate-type compressor of claim 12, wherein said pressure control means comprises a valve connecting said outlet of said compressor with said actuating chamber of said passageway control device.

20. The slant plate-type compressor of claim 12, wherein said passageway control device comprises a valve mechanism including a cylinder bore, a piston reciprocately disposed within said cylinder bore, a valve portion, a spring seat, and a spring member, wherein said spring member is disposed between said valve portion and said spring seat.

21. The slant plate-type compressor of claim 12, wherein said passageway control device comprises a valve mechanism including a bellows, a valve portion, a spring seat, and a spring member disposed between said valve portion and said spring seat.

22. The slant plate-type compressor of claim 12, wherein said passageway control device comprises a valve mechanism including a diaphragm, a valve portion, a spring seat, and a spring member, wherein said spring member is disposed between said valve portion and said spring seat.

* * * * *